US005457614A

United States Patent [19]

Duty

[11] Patent Number: 5,457,614

[45] Date of Patent: Oct. 10, 1995

[54] MAGNETICALLY MOUNTED WORK LIGHT

[76] Inventor: Earl A. Duty, 1603 Holly Pl., Sidney, Ohio 45365

[21] Appl. No.: 297,160

[22] Filed: Aug. 29, 1994

[51] Int. Cl.[6] ..... F21S 3/00

[52] U.S. Cl. ..... 362/220; 362/398

[58] Field of Search ..... 362/398, 220

[56] References Cited

U.S. PATENT DOCUMENTS

| | | | |
|---|---|---|---|
| 3,917,940 | 11/1975 | Duddy | 240/52.15 |
| 4,538,214 | 8/1985 | Fisher et al. | 362/147 |
| 4,564,894 | 1/1986 | Gonzalez | 362/398 |
| 4,727,462 | 2/1988 | Komonko | 362/398 |
| 4,779,178 | 10/1988 | Spitz | 362/260 |
| 4,897,768 | 1/1990 | Thul | 362/398 |
| 4,965,708 | 10/1990 | Louis | 362/398 |
| 5,140,508 | 8/1992 | Komonko | 362/398 |
| 5,217,300 | 6/1993 | Lwery | 362/387 |

*Primary Examiner*—Carroll B. Dority
*Attorney, Agent, or Firm*—Biebel & French

[57] ABSTRACT

A work light including a pair of magnetic base members for supporting the light on a magnetic surface. An arcuate arm extends from each of the base members and a fluorescent light is supported at an end of the arms distal from the base members. The arms may be pivoted relative to the base members in order to position the light at a desired location relative to a work area.

19 Claims, 3 Drawing Sheets

MAGNETICALLY MOUNTED WORK LIGHT

BACKGROUND OF THE INVENTION

The present invention relates to work lights and, more particularly, to work lights which have a magnetic base for supporting the light.

Work lights, such as trouble lights or drop lights, are commonly used to illuminate confined darkened areas on a temporary basis. For example, mechanics often use work lights to illuminate work areas within wheel wells of vehicles, as well as to illuminate dash areas and the engine compartment. Such work lights must be capable of use under various conditions in order to provide adequate illumination while being positioned in a location which does not hinder access to the work area. In addition, means for mounting the lights, such as a hook or magnet, must be provided in order to position the light while permitting a worker to work in the illuminated area.

U.S. Pat. No. 4,564,894 to Gonzales discloses a trouble light for vehicles which utilizes magnets to position and mount the trouble light to more effectively direct light to the desired work area. The magnets are adapted to be mounted directly to the housing of the trouble light such that it is desirable to have a magnetic surface directly adjacent to the area being illuminated.

U.S. Pat. No. 4,727,462 to Komonko discloses a clamp-on magnet for trouble lamps wherein a pair of wire clamps are pivotally mounted to a magnetic base. The wire clamps are adapted to engage the shield of a trouble light whereby the trouble light is magnetically mounted and adapted to move in pivotal relationship to the base.

U.S. Pat. No. 4,965,708 to Louis discloses a light assembly having a magnetized base. The light assembly includes a flexible gooseneck connection between the base and a lamp whereby the lamp may be adjusted to different positions relative to the base.

One problem associated with prior art work lights includes the difficulty of positioning the light in a convenient location which provides illumination for the desired work surface. For example, when additional illumination is required for the wheel well of a vehicle, the magnetically mounted work light must typically be supported from a location outside of the wheel well because the inner wheel well surfaces are typically formed of plastic and therefore define non-magnetic surfaces. In addition, lights having magnetic bases and adapted to be mounted outside of the wheel well often block access of a mechanic through the wheel opening.

A further problem associated with many prior art work lights includes the use of incandescent bulbs which causes heating of the lights, which can potentially burn an operator working near the light. Further, incandescent lights cast shadows in the work area in such a manner that the work area is not fully illuminated.

SUMMARY OF THE INVENTION

The present invention provides a work light which is adapted to be located directly in a work area and which incorporates a fluorescent light to provide shadow free lighting for the work area.

The work light of the present invention includes a pair of base members located in spaced relation to each other. Each of the base members includes a magnet on one side thereof and a dish shaped area for receiving parts on the opposite side thereof. In addition, the base member is preferably formed of a magnetic material such that the dish shaped area is adapted to magnetically retain articles therein.

An arcuately shaped arm extends from each of the base members, and each arm is mounted to a respective base member at a pivot point whereby the arms may be pivotally moved relative to the base members.

An elongated fluorescent light is mounted at an end of the arms distal from the base members. Thus, the light may be moved pivotally to a location distal from the base members and into association with a work area. In addition, the fluorescent light ensures that substantially the entire work area is lighted. Further, the arcuate shape of the arms facilitates locating the light within the work area without obstructing access to the work area.

Therefore, it is a general object of the present invention to provide a work light which is adapted to be magnetically supported.

It is a further object of the invention to provide such a magnetically supported work light wherein the light may be conveniently located in a work area.

It is another object of the invention to provide such a work light wherein the light may be located in the work area without unduly limiting access to the work area.

Other objects and advantages of the invention will be apparent from the following description, the accompanying drawings and the appended claims.

DETAILED DESCRIPTION OF THE PREFERRED EMBODIMENT

Figure 1:
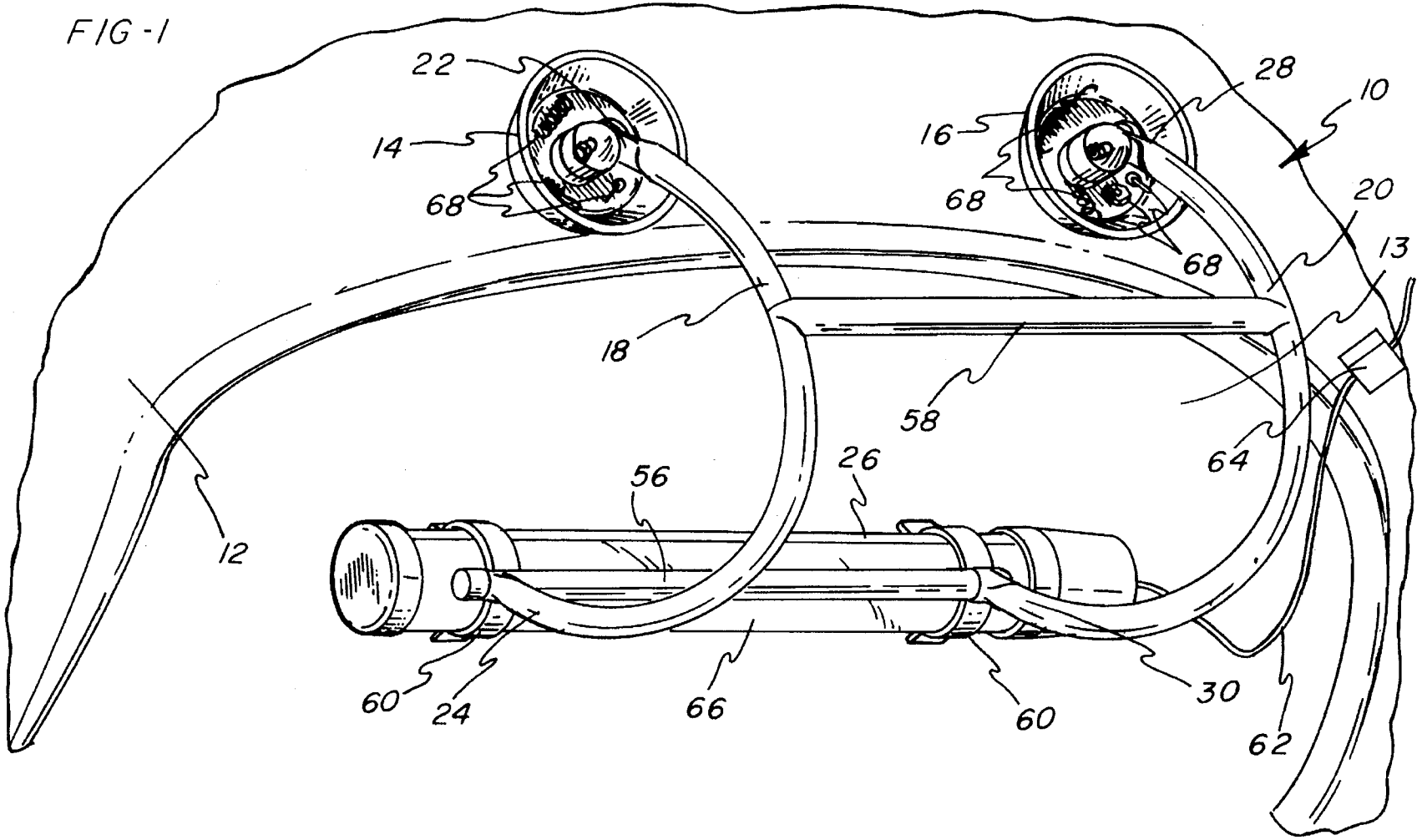
FIG. 1 is a perspective view of the work light of the present invention shown in position to illuminate a wheel well for a vehicle.

The present invention provides a work light which is particularly adapted to be used to illuminate portions of a vehicle having metal body panels. Referring to FIG. 1, the work light 10 of the present invention is shown mounted to the fender 12 of a vehicle, such as a car, immediately above a work area 13 to be illuminated defined by a wheel well for the car. The work light 10 includes a first base member 14 and a second base member 16 supporting respective first and second pivot arms 18 and 20. The pivot arm 18 includes a base end 22 for attachment to the first base member 14 and a distal end for supporting an elongated fluorescent light 26. Similarly, the pivot arm 20 includes a base end 28 and a distal end 30 supporting the light 26.

Figure 2:
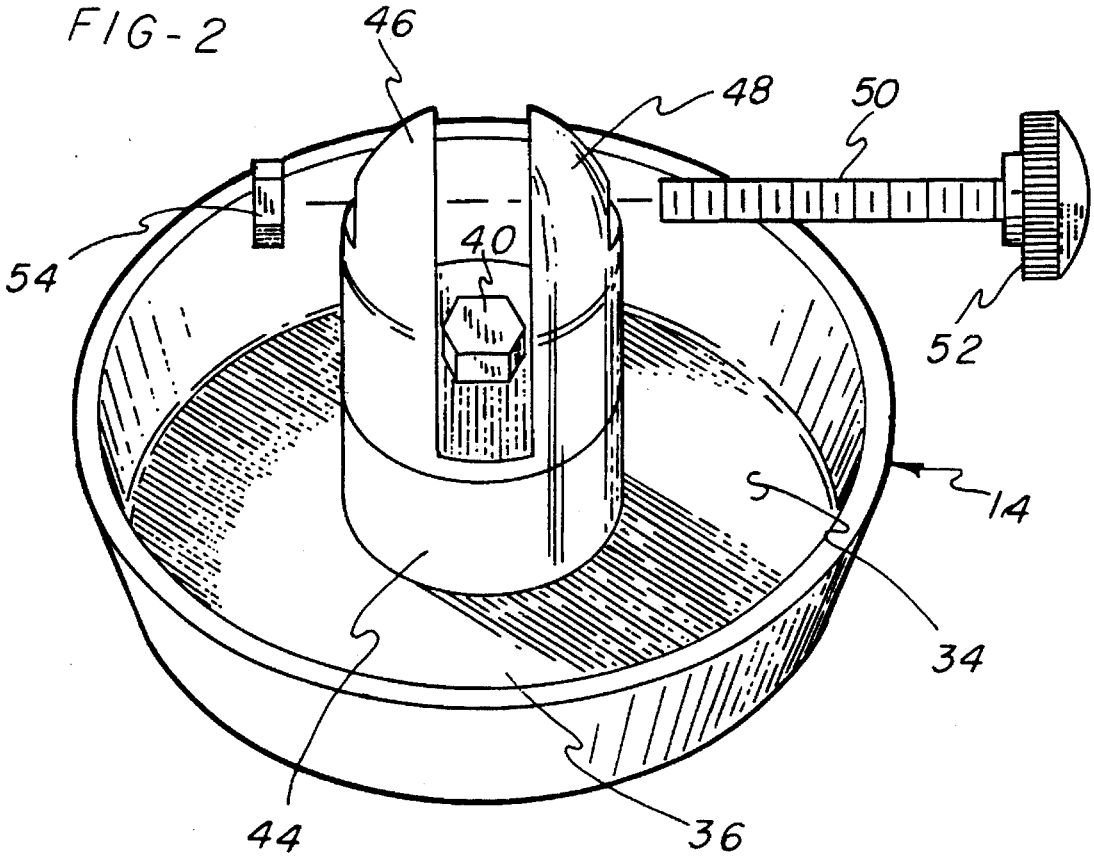
FIG. 2 is a perspective view of a base member for the present work light.
Figure 3:
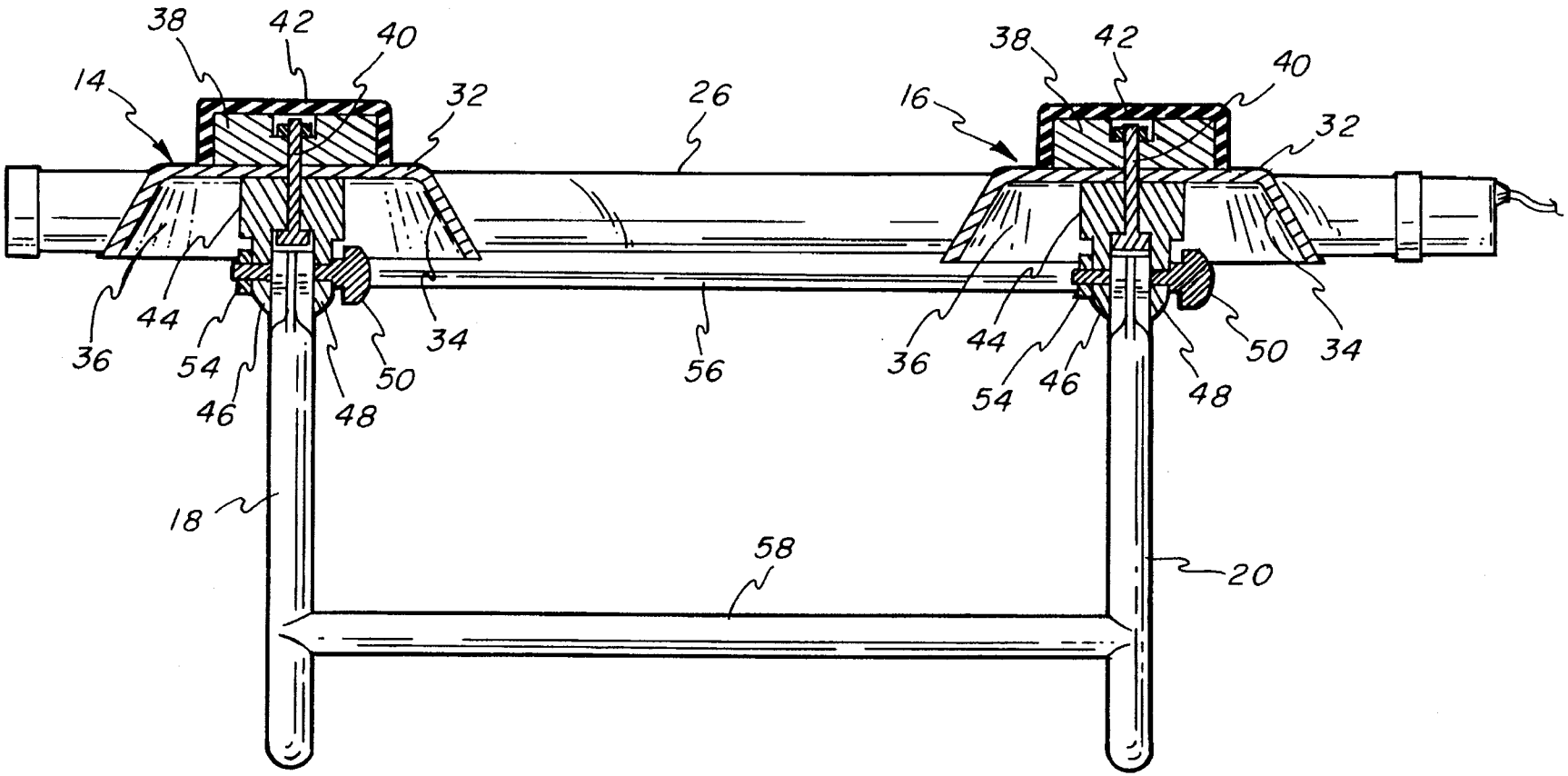
FIG. 3 is a top view of the work light with the base members shown in cross section.

Referring to FIGS. 2 and 3, the base members 14 and 16 are shown, wherein FIG. 2 illustrates the base member 14 and the base member 16 is formed with identical parts labeled with the same reference numerals. Each base member 14, 16 is formed of a magnetic material, such as steel, and defines a first side 32 and a second side 34. In addition, the base members 14, 16 are dish shaped to define a dish shaped article receiving area 36 on the second side 34 for holding screws, bolts, springs or other magnetic parts, as will be described further below.

A magnet 38 is located on the first side 32 and may be held in position by means of a bolt 40. The magnet 38 is preferably provided with a cover 42 formed of rubber or other soft material to prevent the magnet 38 from scratching or marring the finish on a car panel. The base members 14, 16 further include a pivot body or joint 44 which is held in position on the second side 34 by means of the bolt 40 such that the pivot joint 44 is held position in the dish area 36 by the bolt 40. The pivot joint 44 is in the form of a clevice having a pair of outwardly extending fingers 46 and 48 for receiving a respective base end 22, 28 of a pivot arm 18, 20 therebetween. The pivot arms 18, 20 are mounted to the pivot joints 46 by means of a pivot bolt 50 extending through holes in the fingers 46, 48. The bolt 50 preferably includes an enlarged head 52 whereby a worker may hand turn the bolt 50 relative to a nut 54 to tighten the fingers 46 and 48 onto a respective arm 18, 20 such that the bolt 50 and fingers 46, 48 form locking means for maintaining the arms 18, 20 at a desired angular position relative to the base members 14, 16. It should be noted that the enlarged head 52 may take on any of a wide variety of known forms, including the form of a wing nut.

Figure 4:
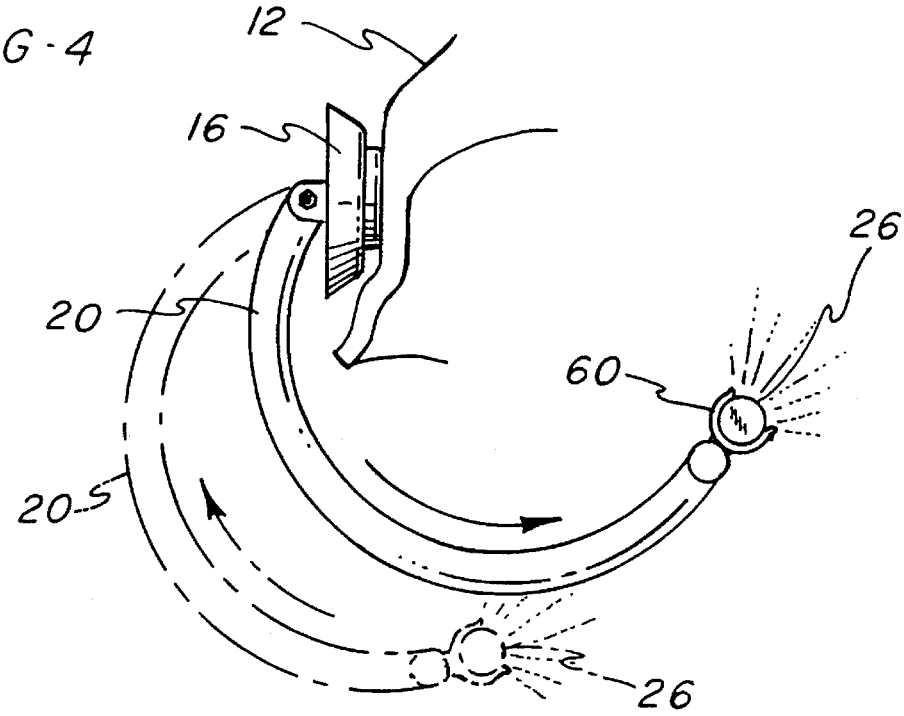
FIG. 4 is a side elevational view of the work light.

As best seen in FIGS. 1 and 4, the pivot arms 18, 20 are arcuately shaped and each arm 18, 20 defines an arc of approximately 180°. In addition, an end cross brace 56 extends between the distal ends 24, 30 of the arms 18, 20, and an intermediate cross brace 58 extends between the first and second arms 18, 20 intermediate the pivot joints 44 and the end brace 56 (see FIG. 3). The braces 56, 58 maintain a predetermined spacing between the arms 18 and 20 during use of the work light 10.

As may be further seen in FIGS. 1 and 4, a spring clip 60 is mounted to the distal ends 24, 30 of each of the arms 18, 20 for at least partially encircling the fluorescent light 26 adjacent to its ends whereby the light 26 is supported at the ends of the arms 18, 20. It should be noted that the fluorescent light is of a conventional design, and in the preferred embodiment the light 26 has a power output of 15 to 50 watts, is 21" long and may be a light such as Model No. 782-5045 manufactured by National Electric Manufacturing Corp. of Commerce, Calif. The light 26 includes a cord 62 extending from one end thereof and a clip-on magnet 64 is attached to the cord 62 at a location distal from the light 26. The magnet 64 enables a worker to attach the cord to a metallic surface of the vehicle being worked upon in order to hold the cord 62 out of the way during use of the work light 10. It should also be noted that the fluorescent light 26 is preferably provided with a light shield 66 surrounding the light 26 on at least one side for preventing the light from shining toward a worker located behind the second side of the base members 14, 16. Thus, the light 26 is adapted to shine only on the work surfaces in the work area, and not into the workers' eyes.

With the base members 14, 16 in position on a metallic surface, such as the fender 12, the-pivot arms 18, 20 are pivotable to position the light 26 at a desired location relative to the work area 13. Specifically, as may be seen in FIG. 4, the arms 18, 20 may be looped underneath a fender 12 whereby the light 26 is supported in cantilever relationship to the base members 14, 16 and is positioned directly in the work area without hindering access of a worker to components located within the work area. Further, as illustrated in phantom lines, the arms 18, 20 may be pivoted to a variety of positions as desired. When the arms are located in a desired position, the bolts 50 may be rotated to lock the arms 18, 20 into position.

The pivot joints 44, arms 18, 20 and braces 56, 58 are preferably formed of a plastic material. By forming the arms of plastic, the risk of scratching or marring paint or chrome during movement of the work light 10 is minimized, and the plastic material provides for a light weight light structure.

Further, it should be noted that by providing base members 14, 16 in spaced relation to each other, a stable support for resisting movement of the light is provided. In particular, it is desirable to provide the elongated fluorescent light 26 with a support which is capable of both holding the weight of the light 26 as well as resisting movement caused by moment forces such as may be exerted if one end of the light is bumped. In addition, by providing spaced base members 14, 16 wherein the base member 14 is pivotable relative to the arm 18 independently of the movement of the base member 16 relative to arm 20, mounting of the present work light 10 on curved surfaces is facilitated in that at least two positive engagement points for the light 10 is assured.

Referring again to FIG. 1, it should be noted that by providing base members 14, 16 formed of a magnetic material and with a dish shaped article receiving area 36, the base members 14, 16 are adapted to retain magnetic components 68 such as screws, bolts, springs and other magnetic articles which will be attracted to the base members 14, 16 by their respective magnets 38.

It should be apparent from the above description that the present work light 10 is adapted to provide illumination to darkened limited access areas while leaving both the worker's hands free to perform an operation in the work area. The present work light 10 is particularly adapted to be used within wheel wells of vehicles to perform various operations such as brake jobs and to work on vehicle axles and suspension components.

It should also be noted that by providing a fluorescent light for the present work light 10, the danger of a worker being burned by the light is minimized in that a fluorescent light produces less heat than an incandescent lamp while illuminating a much broader area and substantially avoiding shadows in the work area.

Thus, by providing a work light which is adapted to be mounted outside of the work area and which provides a relatively large base area for supporting an elongated fluorescent light, the present invention provides a device for efficiently lighting a work area.

Finally, it should be noted that although the present work light has been described with reference to use within a wheel well for a vehicle, the present work light 10 may also be attached to an open hood for lighting an engine compartment or to a roof of a vehicle for providing light through a windshield to illuminate the dashboard area of the vehicle. Further, the present light may be used in any area which may have an access opening which requires illumination such as a stove or machine press panel.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A work light comprising:

a first magnetic base member;

a second magnetic base member located in spaced relation to said first base member;

a first arm having a base end pivotally attached to said first base member and a cantilever end for receiving a light;

a second arm having a base end pivotally attached to said second base member and a cantilever end for receiving a light, said second base member being pivotable relative to said second arm independently of pivotal movement of said first base member relative to said first arm whereby mounting the work light on a surface is facilitated by providing at least two positive engagement points for the work light;

means supporting a light in a cantilevered relationship relative to said first and second base members at said cantilever ends of said first and second arms; and means wherein said first and second arms are pivotally movable simultaneously about said first and second base members when said base members are attached to a surface.

2. The work light as recited in claim 1 including first and second pivot joints located on said first and second base members, respectively, wherein said first and second arms are pivotally mounted to said base members at said pivot joints.

3. The work light as recited in claim 1 wherein each said base member has opposing first and second sides, said first side including a magnet and said second side including an area for magnetically retaining articles attracted by said magnet.

4. The work light as recited in claim 3 wherein said second side of each said base member is substantially dish shaped.

5. The work light as recited in claim 3 wherein said first and second base members are formed of a magnetic material.

6. The work light as recited in claim 1 wherein said arms are arcuately shaped whereby said light is located within a wheel well for a car behind said first and second base members when said base members are attached to an outer surface of a fender defining the wheel well.

7. The work light as recited in claim 1 wherein said light is a fluorescent light.

8. The work light as recited in claim 7 wherein said supporting means includes clips located adjacent to ends of said arms distal from said base ends, said clips at least partially encircling said light whereby said light is mounted to said arms.

9. The work light as recited in claim 1 including an electrical cord extending from said light and a magnet attached to said cord for attachment to a magnetic surface whereby said cord is held at a desired location.

10. A work light comprising:

a base member having opposing first and second sides;

a magnet located on said first side of said base member;

an article receiving area defined on said second side of said base member for magnetically retaining articles placed on said second side and attracted by said magnet, said receiving area being defined by a dish shaped portion on said second side of said base member;

an arm extending from said base; and a light attached to said arm.

11. The work light as recited in claim 10 including a pivot joint located on said second side of said base member for pivotally mounting said arm.

12. The work light as recited in claim 10 wherein said arm is arcuately shaped whereby said light is located within a wheel well for a car when said base member is attached to a fender defining the wheel well.

13. The work light as recited in claim 10 wherein said light is a fluorescent light.

14. The work light as recited in claim 13 including an additional arm wherein said arm and said additional arm support said fluorescent light at opposite ends of said light.

15. The work light as recited in claim 13 including a clip located at an end of said arm distal from said base member, said clip at least partially encircling said light whereby said light is mounted to said arm.

16. The work light as recited in claim 10 including an electrical cord extending from said light and a magnet attached to said cord for attachment to a magnetic surface whereby said cord is held at a desired location.

17. A work light comprising:

a first base member having opposing first and second sides;

a second base member having opposing first and second sides and located in spaced relation to said first base member;

a magnet located on said first side of each of said first and second base members;

each said base member being dish shaped and being formed of a magnetic material for magnetically retaining magnetic articles in said base members;

first and second pivot joints defined on said second side of said first and second base members, respectively;

first and second pivot arms pivotally mounted to said first and second pivot joints, respectively, each said arm comprising an arcuate elongated member defining an arc of approximately 180 degrees;

locking means for locking said arms at a desired angle relative to said base members;

an end brace extending between said first and second pivot arms at an end of said arms distal from said pivot joints;

an intermediate brace extending between said first and second arms at a point along said arms intermediate said pivot joints and said end brace;

spring clips located adjacent to ends of said arms distal from said pivot joints;

an elongated fluorescent light, said spring clips at least partially encircling said fluorescent light whereby said light is mounted to said arms, said arms supporting said light in cantilever relationship to said base members; and a shield surrounding said light on at least one side for preventing said light from shining toward a worker located behind said second side of said base members.

18. The work light as recited in claim 1 wherein said light is elongated and said first and second arms support said light at opposing ends thereof.

19. The work light as recited in claim 1 including first locking means associated with said first pivot joint for locking said first arm into a plurality of positions relative to said first base member, and second locking means associated with said second pivot joint for locking said second arm into a second plurality of positions relative to said second base member.

* * * * *